US011028601B2

(12) United States Patent
Nudo

(10) Patent No.: US 11,028,601 B2
(45) Date of Patent: Jun. 8, 2021

(54) TILE SPACER

(71) Applicant: ME INNOVATIONS PTY LTD, Glynde (AU)

(72) Inventor: Enzo Nudo, Glynde (AU)

(73) Assignee: ME INNOVATIONS PTY LTD, Glynde (AU)

( * ) Notice: Subject to any disclaimer, the term of this patent is extended or adjusted under 35 U.S.C. 154(b) by 0 days.

(21) Appl. No.: 16/845,426

(22) Filed: Apr. 10, 2020

(65) Prior Publication Data

US 2020/0240154 A1 Jul. 30, 2020

Related U.S. Application Data

(63) Continuation of application No. PCT/AU2018/051096, filed on Oct. 10, 2018.

(30) Foreign Application Priority Data

Oct. 10, 2017 (AU) ..... 2017904087

(51) Int. Cl.
*E04F 21/00* (2006.01)

(52) U.S. Cl.
CPC ..... *E04F 21/0092* (2013.01)

(58) Field of Classification Search
CPC ..... E04F 13/0892; E04F 15/02022; E04F 15/02005; E04F 15/022; E04F 21/0092; E04F 21/22; E04F 21/1877; E04F 21/1844; E04F 21/185
See application file for complete search history.

(56) References Cited

U.S. PATENT DOCUMENTS 4,289,818 A * 9/1981 Casamayor ..... A47K 3/001 4/614
7,140,156 B1 * 11/2006 Lowe, Jr. ..... E04F 15/02183 52/263
7,631,461 B2 * 12/2009 Shadwell ..... E04D 1/20 52/525

(Continued)

FOREIGN PATENT DOCUMENTS

AU 2011203224 B2 8/2012
DE 202011103629 U1 * 3/2012 ..... E04F 15/02022

(Continued)

*Primary Examiner* — Christine T Cajilig

(57) ABSTRACT

A tile spacer comprises a base for engaging a bottom surface of tiles and a stem projecting upwardly from the base. The stem comprises two oppositely facing surfaces and two projections (36, 38) extending in opposite directions from the surfaces so that the stem and the projections define cross-shaped profile with corners for contacting corners of four tiles. At least one of the surfaces of the stem includes a recessed, i.e. set-back, area. The projections extend from the recessed areas. One or both projections can be removed from the stem by breaking the projection(s) so that the tile spacer can be used with four, three or two tiles depending on whether one or both projections is removed. The recessed areas confine any residual material of the projection(s) that is not removed when the projection(s) is broken at least substantially within the recessed area(s) and minimises or avoids altogether interference with laying tiles.

17 Claims, 2 Drawing Sheets

(56) References Cited

U.S. PATENT DOCUMENTS

| | | | | |
|---|---|---|---|---|
| 8,950,079 | B2 * | 2/2015 | Hillebrandt | E04F 15/02005 33/527 |
| 9,303,415 | B1 * | 4/2016 | Cipriano | E04F 21/0076 |
| 2013/0067854 | A1 * | 3/2013 | Bordin | E04F 21/0092 52/749.11 |
| 2015/0211243 | A1 * | 7/2015 | Irvine | E04F 21/22 52/126.1 |
| 2019/0048599 | A1 * | 2/2019 | Papadatos | E04F 21/20 |

FOREIGN PATENT DOCUMENTS

| | | | | |
|---|---|---|---|---|
| EP | 2762658 | B1 | 9/2015 | |
| EP | 3147423 | A1 * | 3/2017 | E04F 21/0092 |
| WO | 2014022889 | A1 | 2/2014 | |

* cited by examiner

TILE SPACER

FIELD OF THE INVENTION

The present invention relates to tiling walls and floors and any other surfaces.

In particular, the present invention relates to a tile spacer for use in a tile spacer and levelling system and to a method for spacing and levelling tiles.

BACKGROUND

Laying tiles on a substrate, such as a wall or a floor, can be a daunting task that requires a high level of tradesman skills to achieve good results.

In particular, it can be difficult to place tiles uniformly on the substrate to obtain a flat surface with a set spacing between tiles.

An installer of tiles has first to plan a layout of the tiles having regard to a substrate on which the tiles will be laid and the dimensions of the tiles.

The installer needs then to check and prepare the substrate to be tiled by checking the measurements, the extent to which the areas to be tiled are square and, in the case of wall areas, the extent to which the walls are vertical and the substrates are flat surfaces.

Additionally, it can prove to be challenging to lay out a uniform thickness of tile adhesive for fixing the tiles to the substrate, and a lack of uniformity can lead to undesired imperfection in the final result.

International application WO 2014/022889 in the name of the applicant discloses a tile spacer for use in a tile spacer and levelling system and a method for spacing and levelling tiles. The disclosure in the International application is incorporated herein by cross-reference.

The International application discloses a tile spacer comprising:

a base for engaging a bottom surface of each of four adjacent tiles to be spaced and levelled;

a stem projecting upward from the base, the stem comprising:

a tile alignment portion having a cross-shaped profile;

a frangible portion located between the base and the tile alignment portion; and a tile leveler for engaging a top surface of the four adjacent tiles, wherein, in use, the tile spacer is located at the intersection of the four adjacent tiles such that the base is located beneath the four adjacent tiles, and each tile abuts a corner of the alignment portion so as to space the four adjacent tiles at a predetermined distance with respect to each other; and wherein the four adjacent tiles are levelled by applying a clamping force on the four adjacent tiles between the base and the tile leveler, to simultaneously level the four adjacent tiles Whilst the above-described tile spacer of the International application is an effective product for many applications, there is a need for an alternative system and method for laying tiles on the substrate.

The above description is not an admission of the common general knowledge in Australia or elsewhere.

SUMMARY OF THE INVENTION

In broad terms, the invention provides a tile spacer that comprises a base for engaging a bottom surface of tiles and a stem projecting upwardly from the base. The stem comprises two oppositely facing surfaces and two projections extending in opposite directions from the surfaces so that the stem and the projections define a cross-shaped profile with corners for contacting corners of four tiles. At least one of the surfaces of the stem includes a recessed, i.e. set-back, area (which may also be described as a set-back section). The projections extend from the recessed areas. One or both projections can be removed from the stem by breaking the projection(s) so that the tile spacer can be used with four, three or two tiles depending on whether one or both projections is removed. The recessed areas confine any residual material of the projection(s) that is not removed when the projection(s) is broken at least substantially within the recessed area(s) and minimises or avoids altogether interference with laying tiles.

The present invention more particularly provides a tile spacer for spacing tiles on a substrate, the tile spacer comprising:

(a) a base for engaging a bottom surface of tiles to be spaced on the substrate; and (b) a stem projecting upwardly from the base, the stem having two oppositely facing surfaces, the stem comprising a tile alignment portion comprising (i) the two oppositely facing surfaces and (ii) two projections extending in opposite directions from the surfaces, with one projection extending from one oppositely facing surface and the other projection extending from the other oppositely facing surface, so that the tile alignment portion defines a cross-shaped profile in transverse section, wherein the cross-shaped profile defines corners for positioning corners of four tiles on the substrate, and wherein at least one of the surfaces of the tile alignment portion includes a recessed area and one of the projections extends from the recessed area; and wherein, in use, none, one or both of the projections can be removed from the tile alignment portion, for example by breaking the projection or projections, so that the tile alignment portion can be adapted for use with four, three or two tiles respectively to space apart at least two adjacent tiles depending on whether one or both projections are removed, and wherein any residual material of the projection or projections that is not removed with the projection or projections and extend from the tile alignment portion is at least substantially confined within the recessed area or areas and minimises or avoids altogether interference with laying tiles on the substrate.

It is understood herein that the term "recessed" area is a section of the surface that is set-back relative to a main plane of the surface.

In some embodiments, at least one of the two projections comprise a breakable portion adjacent, i.e. close to, the surface of the recessed area from which the projection extends, i.e. at a location that is within the recessed area.

Each projection may have a breakable portion adjacent, i.e. close to, the surface of the recessed area from which the projection extends, i.e. at a location that is within the recessed area.

The breakable portion may be made of a frangible material.

The breakable portion may be made of a tearable material.

The breakable portion may comprise discontinuous segments of material.

In some embodiments, the breakable portion is a reduced transverse cross-sectional area of the projection that defines an area of weakness at which the projection can preferentially break from the surface of the tile alignment portion from which the projection extends.

By way of example, the reduced transverse cross-sectional area could be formed by tapering the projection inwardly towards the surface of the recessed area of the tile alignment portion from which the projection extends.

In some embodiments, at least one of the two projections is made of different material from the tile alignment portion.

In some embodiments, the depth of the recessed area relative to the main plane of the surface is such that the residual material is completely confined within the recessed area.

In an embodiment, the depth of the recessed area is at least 0.5 mm, typically at least 1 mm.

The depth may be less than 5 mm.

The depth may be between 0.5 and 5 mm.

Typically, the depth is between 0.5 and 4 mm.

The stem may comprise a breakable portion located between the base and the stem.

In some embodiments, the breakable portion located between the base and the stem has a reduced transverse cross-sectional area that defines an area of weakness at which the stem can preferentially break from the base.

By way of example, the reduced transverse cross-sectional area could be formed by tapering the stem inwardly towards the base.

In some embodiments, the breakable portion located between the base and the stem is made from a frangible material or a tearable material.

The tile spacer may be an injection moulded unit, i.e. moulded as a one-piece unit.

The tile spacer may be formed by any other suitable manufacturing option.

The present invention also provides a method for spacing and levelling tiles using the tile spacer described above, the method comprising:

(a) removing none, one or both of the projections from the tile alignment portion depending on whether the tile spacer is to be used in relation to two, three, or four adjacent tiles, (b) positioning the tile spacer on a surface to be tiled, (c) positioning a bottom surface of each of the tiles to be spaced and levelled on the base of the tile spacer;

(d) applying a force to the two, three, or four adjacent tiles as required to level adjacent tiles, and (e) removing the stem of the spacer.

The step of applying a force may comprise using a tile leveller, such as described in the above-mentioned International application WO 2014/022889 in the name of the applicant.

The step of removing one or both of the projections from the tile alignment portion may comprise snapping or otherwise fracturing or removing one or both of the projections from the tile alignment portion.

In some embodiments, the step of removing one or both of the projections from the tile alignment portion comprises tearing one or both of the projections away from the tile alignment portion.

The step of removing the stem of the spacer may comprise breaking the breakable portion located between the base and the stem.

BRIEF DESCRIPTION OF THE DRAWINGS

In order that the tile spacer of the invention may be more clearly ascertained, an embodiment will now be described, by way of example, with reference to the accompanying drawings, in which.

DETAILED DESCRIPTION OF AN EMBODIMENT OF THE INVENTION

Figure 1:
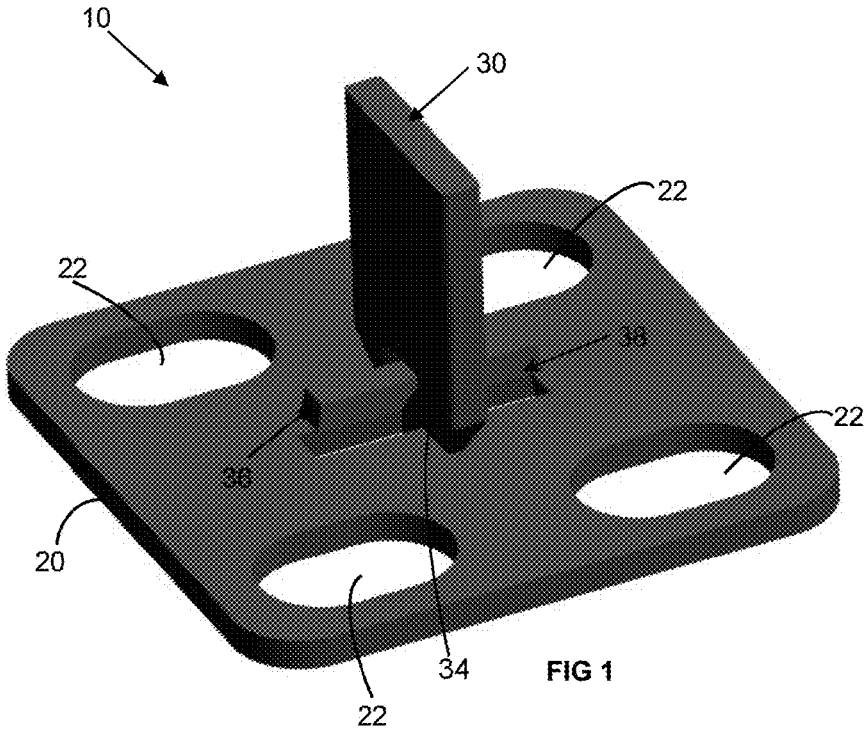
FIG. 1 shows a perspective view of an embodiment, although not the only embodiment, of a tile spacer in accordance with the invention.

FIG. 1 shows a tile spacer 10 for use in a tile spacer and levelling system.

The tile spacer may be an injection moulded unit, i.e. moulded as a one-piece unit. The tile spacer may be formed by any other suitable manufacturing option.

The tile spacer 10 includes a base 20 for contacting a bottom surface of tiles to be spaced and levelled and a stem 30 projecting upwardly from the base 20.

In the described embodiment, the base 20 is in the form of a square plate with four elliptical apertures 22. The apertures 22 are provided so that, in use, tile adhesive can penetrate the apertures.

In use, tile adhesive is applied to a substrate (not shown) to be tiled, such as a wall or a floor, the tile spacer 10 is positioned on the substrate so that it is at least partially embedded in the tile adhesive, and tiles are positioned to at least partially abut an upper surface of the base 20. The apertures 22 provide a direct key between tile adhesive and the tiles, thereby improving adhesion between the substrate and the tiles.

In other embodiments, the base 20 is a solid plate with no apertures.

In other embodiments the base 20 is any other suitable shape.

In all embodiments, the base 20 is any suitable size.

The apertures 22 may also have different shapes and dimensions and may be differently located and spaced in the base 20. The apertures 22 may also be any suitable number.

The stem 30 is a generally elongate member that is rectangular in transverse section with a pair of opposed longer sides and a pair of opposed shorter sides.

The stem 30 comprises (a) a tile alignment portion generally identified by the numeral 34 and (b) a breakable portion 32 located between the base 20 and the tile alignment portion.

The breakable portion 32 allows the stem 30 to be separated easily from the base 20.

The tile alignment portion 34 comprises two oppositely facing surfaces (which in this embodiment are part of the surfaces of the longer sides of the stem). These surfaces are surfaces against which, in use, tiles can be abutted to position the tiles in relation to the tile spacer.

Figure 2A:
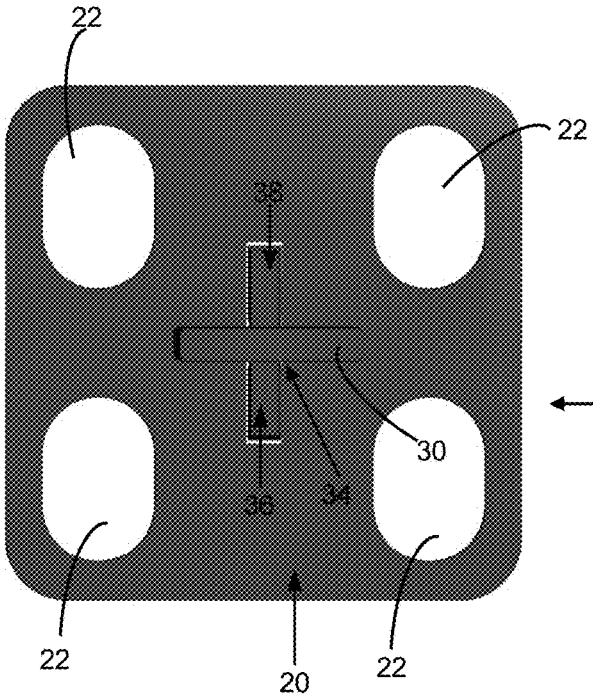
FIG. 2A shows a top plan view of the tile spacer of FIG. 1.
Figure 2B:
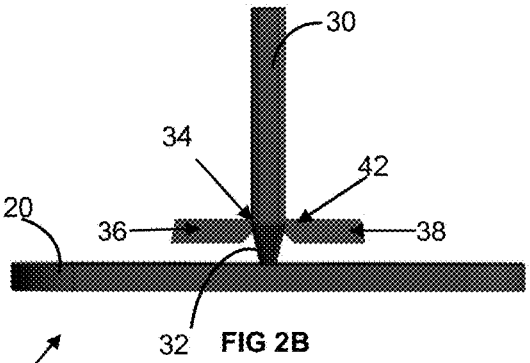
FIG. 2B shows a side elevation view of the tile spacer of FIG. 1.
Figure 2C:
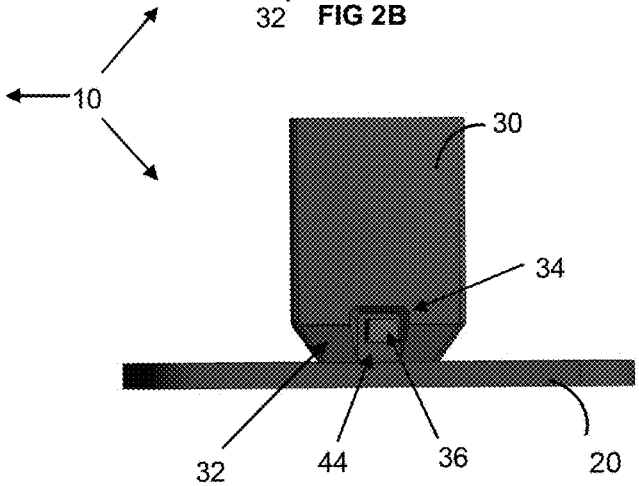
FIG. 2C shows a different side elevation view of the tile spacer of FIG. 1.

As is more clearly seen in FIGS. 2A to 2C, the tile alignment portion 34 also comprises two projections 36, 38 extending in opposite directions, with one projection 36, 38 extending from one oppositely facing surface and the other projection 36, 38 extending from the other oppositely facing surface. The projections 36, 38 also define surfaces against which, in use, tiles can be abutted to position the tiles on the substrate in relation to the tile spacer.

The oppositely facing surfaces of the tile alignment portion 34 and the projections 36, 38 of the tile alignment portion 34 define a cross-shaped profile in transverse section—see FIG. 2A. The cross-shaped profile defines square corners.

It can be appreciated that, in use, this arrangement shown in the Figures facilitates positioning four tiles against the oppositely facing surfaces of the tile alignment portion 34 and the projections 36, 38 of the tile alignment portion 34, with adjacent tiles being spaced apart by the thickness of the oppositely facing surfaces and the thickness of the projections 36, 38 and the tiles being positioned in a square orientation on the substrate.

It is noted that the thickness of the oppositely facing surfaces and the thickness of the projections 36, 38 are selected having regard to the typical required spacing between adjacent tiles. Typically, the thicknesses are the same.

In use, one or both of the projections 36, 38 can be removed from the oppositely facing surfaces so that the tile alignment portion 34 can be adapted for use with two or three tiles rather than four tiles when used in the arrangement shown in the Figures.

A tiler may elect to use the tile spacer 10 to lay two, three or four tiles on the substrate depending on the substrate and the desired layout. For example, invariably there will be situations where it is necessary to space four tiles, other situations where it is necessary to space three tiles, and other situations where it is necessary to space two tiles only.

Advantageously, using the tile spacer 10 according to the invention, the tiler does not need multiple types of tile spacers to account for possible different tiles layouts. This greatly simplifies manufacture of tile spacers, the inventory of different tile spacers that have to be carried by retail outlets, and simplifies tiling substrates.

The tiler can use the tile spacer 10 in the as-manufactured form shown in the Figures if four tiles are to be laid.

Alternatively, by removing one of the projections 36, 38, three tiles can be laid.

Finally, by removing both projections 36, 38, thereby leaving the stem 30 without projections 36, 38, the tile spacer 10 can be used to lay two tiles.

In the described embodiment, the two projections 36, 38 each comprise a breakable portion 42. In some other embodiments, only one of the projections 36, 38 has a breakable portion 42—see FIGS. 2B, 3A, and 3B.

In some embodiments the breakable portion 42 is made of frangible material. In some other embodiments the breakable portion 42 is made of tearable material. The invention is not limited to a particular configuration of the breakable portion 42.

In an embodiment, not shown, the breakable portion 42 comprises discontinuous segments of material to facilitate the removal of the projections 36, 38 from the tile alignment portion 34.

As more clearly seen in FIG. 2B, in the described embodiment, each of the two projections 36, 38 has a reduced transverse cross-sectional area that defines an area of weakness at which the projections 36, 38 preferentially break in use of the tile spacer. This is the breakable portion 42.

In the described embodiment the reduced transverse cross-sectional area of each of the two projections 36, 38 is formed by tapering the projections inwardly towards the oppositely facing surface from which the projection 36, 38 extends.

In some other embodiments at least one of the two projections 36, 38 is made of a different material from the tile alignment portion 34 and the materials selection facilitates preferential breaking of the projections 36, 38.

The above described alternatives have the purpose of introducing a weakness in the projections 36, 38 for facilitating the removal thereof from the tile alignment portion 34.

Each of the two oppositely facing surfaces of the tile alignment portion 34 includes a recessed area 44, which can also be described as a recessed section, and the projections 36, 38 extend from the recessed areas 44. The recessed areas 44 are set-back from the main planes, i.e. the flat surfaces that form the main parts of the oppositely facing surfaces. The recessed areas 44 reduce or remove altogether the possibility that residual material of the projection 36, 38 that is on the oppositely facing surfaces when the projections 36, 38 are removed extends from the surfaces with the result that the residual material interferes with locating tiles on the spacer.

Figures 3A, 3B:
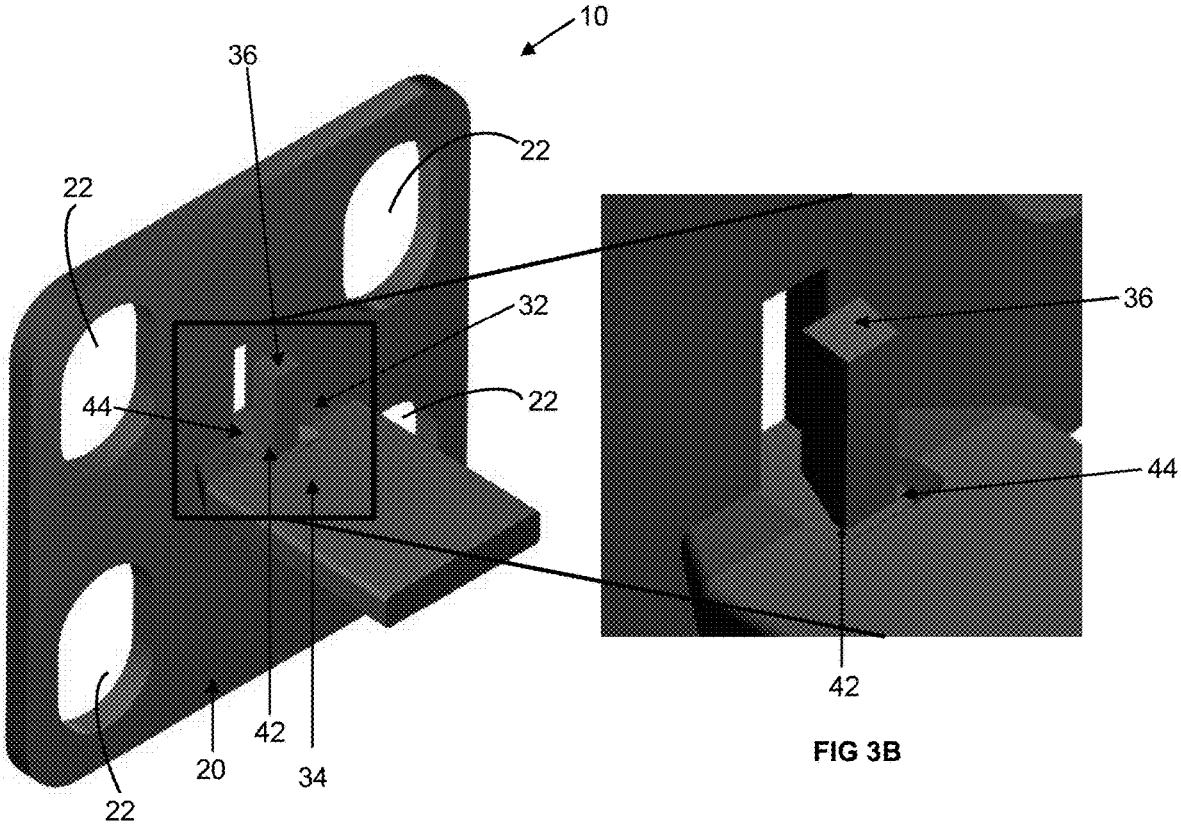
FIG. 3A shows a different perspective view of the tile spacer of FIG. 1.
FIG. 3B shows a magnified view of the boxed area in FIG. 3A.

Referring to FIGS. 3A and 3B, in the described embodiment the recessed areas 44 of both oppositely facing surfaces have a square shape with a depth such that any residual material that is on the oppositely facing surfaces when the projections 36, 38 are removed is completely confined within the recessed areas 44.

It is noted that in other embodiments it is acceptable from a performance perspective that a small amount of material extend from the recessed area 44, provided this residual material does not interfere with locating tiles on the spacer.

The depth of the recessed areas 44 is preferably at least 0.5 mm, typically at least 1 mm. The depth may be less than 5 mm. The depth may be between 0.5 and 5 mm. Typically, the depth is between 0.5 and 4 mm.

As mentioned above the stem 30 of the tile spacer 10 comprises a breakable portion 32 located between the base 20 and the tile alignment portion 34.

As is more clearly seen in FIGS. 2B and 2C, in the described embodiment breakable portion 32 of the stem 30 is a reduced transverse cross-sectional area that defines an area of weakness at which the stem 30 preferentially breaks. The reduced transverse cross-sectional area is formed by tapering the stem 30 inwardly towards the base 20. As is more clearly evident in FIGS. 2B and 2C, in the described embodiment the stem 30 tapers towards the base 20 in two directions. In other embodiments the stem 30 tapers only in one direction. In some other embodiments the stem 30 does not reduce in thickness but is otherwise formed to define a breakable portion 32.

The above described alternatives introduce a weakness between the stem 30 and the base 20 that, in use, facilitates removal of the stem 30 from the base 20.

The above-described tile spacer 10 allows a tiler to lay tiles in a reliable and uniform way.

In use, a tiler decides whether the tile spacer 10 is required for two, three, or four tiles. Depending on the physical characteristics and/or material composition of the projections 36, 38 and of the oppositely facing surfaces of the tile alignment portion 34, the projections 36, 38 are removed by snapping, fracturing, tearing or the like from the oppositely facing surfaces.

The tiler then applies a layer of tile adhesive to a substrate, such as a wall or a floor to be tiled and then positions the tile spacer 10 on the substrate, at least partially embedded in the tile adhesive.

The tiles to be spaced and levelled are then positioned on the base 20 of the tile spacer 10.

The tiles are then placed up against the one or more projections 36, 38 and the appropriate oppositely facing surface or surfaces of the tile alignment portion 34, thereby, abutting these one or more projections 36, 38 and oppositely facing surfaces. The one or more projections 36, 38 and oppositely facing surfaces define the correct position of the tiles on the substrate and assure correct spacing between adjacent tiles.

In the embodiment shown in the Figures, the four apertures 22 in the base 20 increase surface contact between the substrate and the bottom of the tiles. As mentioned above, in other embodiments the apertures 22 can have different shapes and size. The number of apertures can vary and in some embodiments the base 20 is a solid plate with no aperture.

The tiler then applies a force to the two, three, or four adjacent tiles to level the four adjacent tiles. In some cases, the tiles are heavy enough thereby providing adequate pressure on the substrate for the tiles to adhere and set. In other cases the tiler applies pressure manually on the tiles. In some other cases a tile leveller (not shown—but described in the above-mentioned International application WO 2014/022889) is employed. The tile leveller helps achieve a better levelling of the tiles and in turn a more uniform surface.

The tile adhesive is left to dry for the required time, depending on type of mortar or adhesive, substrate characteristics, and material of the tiles.

When the tile adhesive is set, the stem 30 of the tile spacer 10 is removed by breaking the breakable portion 32 located between the base 20 and the tile alignment portion 34.

Depending on the physical characteristics and/or material composition of the breakable portion 32 of the stem 30, the stem 30 is removed by snapping, fracturing, tearing or the like.

The above described method can be varied as required.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A tile spacer for spacing tiles on a substrate, the tile spacer comprising:

(a) a base for engaging a bottom surface of tiles to be spaced on the substrate; and (b) a stem projecting upwardly from the base, the stem having two oppositely facing surfaces, the stem comprising a tile alignment portion comprising (i) the two oppositely facing surfaces and (ii) two projections extending in opposite directions from the surfaces and spaced above the base, with one projection extending from one oppositely facing surface and the other projection extending from the other oppositely facing surface, so that the tile alignment portion defines a cross-shaped profile in transverse section, wherein the cross-shaped profile defines corners for positioning corners of four tiles on the substrate, and wherein at least one of the surfaces of the tile alignment portion includes a recessed area that is set-back relative to a main plane of the surface and one of the projections extends from the recessed area; and wherein, in use, none, one or both of the projections can be removed from the tile alignment portion so that the tile alignment portion can be adapted for use with four, three or two tiles respectively to space apart at least two adjacent tiles depending on whether one or both projections are removed, and wherein any residual material of the projection or projections that is not removed with the projection or projections and extend from the tile alignment portion is at least substantially confined within the recessed area or areas and minimises or avoids altogether interference with laying tiles on the substrate.

2. The tile spacer of claim 1, wherein at least one of the two projections comprise a breakable portion adjacent the surface of the recessed area from which the projection extends, i.e. at a location that is within the recessed area.

3. The tile spacer of claim 2, wherein the breakable portion is made of frangible material.

4. The tile spacer of claim 2, wherein the breakable portion is made of tearable material.

5. The tile spacer of claim 2, wherein the breakable portion comprises discontinuous segments of material.

6. The tile spacer of claim 2, wherein the breakable portion is a reduced transverse cross-sectional area of the projection that defines an area of weakness at which the projection can preferentially break from the surface of the tile alignment portion from which the projection extends.

7. The tile spacer of claim 6, wherein the reduced transverse cross-sectional area is formed by tapering the projection inwardly towards the recessed area of from which the projection extends.

8. The tile spacer of claim 1, at least one of the two projections is made of different material from the tile alignment portion.

9. The tile spacer of claim 1, wherein the depth of the recessed area is such that the residual material is completely confined within the recessed area.

10. The tile spacer of claim 1, wherein the depth of the recessed area is at least 0.5 mm.

11. The tile spacer of claim 1, wherein the stem comprises a breakable portion located between the base and the stem.

12. A method for spacing and levelling tiles using the tile spacer of claim 1, the method comprising:

(a) removing none, one or both of the projections from the stem depending on whether the tile spacer is to be used in relation to two, three, or four adjacent tiles, (b) positioning the tile spacer on a surface to be tiled, (c) positioning bottom surfaces of each of the tiles to be spaced and levelled on the base of the tile spacer;

(d) applying a force to the two, three, or four adjacent tiles as required to level adjacent tiles, and (e) removing the stem of the spacer.

13. The method of claim 12, wherein the step of applying a force comprises using a tile leveller.

14. The method of claim 12, wherein the step of removing one or both of the projections from the tile alignment portion comprises snapping or otherwise fracturing or removing one or both of the projections from the tile alignment portion.

15. The method of claim 12, wherein the step of removing one or both of the projections from the tile alignment portion comprises tearing one or both of the projections away from the tile alignment portion.

16. The method of claim 12 wherein the step of removing the stem of the spacer comprises breaking a breakable portion located between the base and the stem.

17. A tile spacer comprises a base for engaging a bottom surface of tiles and a stem projecting upwardly from the base, with the stem comprising two oppositely facing surfaces and two projections extending in opposite directions from the surfaces and spaced above the base, with the stem and the projections defining a cross-shaped profile with corners for contacting corners of four tiles, at least one of the surfaces of the stem including a recessed, i.e. set-back, area relative to a main plane of the surface, and at least one of the projections extending from the recessed areas, wherein in use one or both projections can be removed from the stem by breaking the projection(s) so that the tile spacer can be used with four, three or two tiles depending on whether one or both projections is removed, with the recessed areas confining any residual material of the projection(s) that is not removed when the projection(s) is broken at least substantially within the recessed area(s) and thereby minimises or avoids altogether interference with laying tiles.

* * * * *